US009145619B2

(12) United States Patent
Andreacchi et al.

(10) Patent No.: US 9,145,619 B2
(45) Date of Patent: Sep. 29, 2015

(54) ELECTROPOLISHING METHOD INCLUDING MULTI-FINGER CONTACTS

(75) Inventors: Anthony S. Andreacchi, San Jose, CA (US); Randolph von Oepen, Aptos, CA (US); Sophia L. Wong, Milipitas, CA (US); William E. Webler, San Jose, CA (US); Christoph Diederichs, Stuttgart (DE); Kevin J. Ehrenreich, San Francisco, CA (US); Denis Tauz, Santa Clara, CA (US)

(73) Assignee: ABBOTT CARDIOVASCULAR SYSTEMS, INC., Santa Clara, CA (US)

( * ) Notice: Subject to any disclaimer, the term of this patent is extended or adjusted under 35 U.S.C. 154(b) by 0 days.

(21) Appl. No.: 13/617,877

(22) Filed: Sep. 14, 2012

(65) Prior Publication Data

US 2014/0076719 A1 Mar. 20, 2014

(51) Int. Cl.
*C25F 3/16* (2006.01)
*C25F 7/00* (2006.01)

(52) U.S. Cl.
CPC .... *C25F 7/00* (2013.01); *C25F 3/16* (2013.01)

(58) Field of Classification Search
CPC ..... A61F 2002/91508–2002/91591
USPC ..... 204/224 M
See application file for complete search history.

(56) References Cited

U.S. PATENT DOCUMENTS

| | | | | |
|---|---|---|---|---|
| 4,127,459 | A | 11/1978 | Jumer | |
| 7,208,070 | B2 | 4/2007 | Swain | |
| 7,252,746 | B2 * | 8/2007 | Schaeffer | 204/224 M |
| 2004/0267351 | A1 * | 12/2004 | Swain | 623/1.15 |
| 2005/0098444 | A1 | 5/2005 | Shaeffer | |
| 2007/0034527 | A1 * | 2/2007 | Diaz et al. | 205/686 |
| 2007/0034528 | A1 | 2/2007 | Diaz et al. | |
| 2007/0156215 | A1 | 7/2007 | Jensen et al. | |
| 2007/0209947 | A1 | 9/2007 | Shrivastava et al. | |
| 2008/0312747 | A1 * | 12/2008 | Cameron et al. | 623/23.7 |
| 2009/0255827 | A1 | 10/2009 | Andreacchi et al. | |
| 2011/0247943 | A1 * | 10/2011 | Bialas et al. | 205/671 |
| 2012/0199489 | A1 | 8/2012 | Vacheron | |
| 2014/0360887 | A1 | 12/2014 | Andreacchi et al. | |

FOREIGN PATENT DOCUMENTS

JP H0790694 4/1995

OTHER PUBLICATIONS

U.S. Appl. No. 13/618,407, filed Sep. 14, 2012, Andreacchi.
U.S. Appl. No. 13/618,348, filed Sep. 14, 2012, Andreacchi et al.
U.S. Appl. No. 13/618,455, filed Sep. 14, 2012, Andreacchi et al.
U.S. Appl. No. 13/618,348, filed Dec. 19, 2013, Office Action.
U.S. Appl. No. 13/618,348, Mail Date Apr. 16, 2014, Notice of Allowance.
U.S. Appl. No. 13/618,455, Mail Date May 8, 2014, Office Action.
U.S. Appl. No. 13/618,407, Mail Date Dec. 2, 2014, Office Action.
U.S. Appl. No. 13/618,455, Mail Date Sep. 25, 2014, Office Action.
U.S. Appl. No. 13/618,407, Mail Date May 13, 2015, Notice of Allowance.
U.S. Appl. No. 13/618,455, Mail Date Feb. 2, 2015, Notice of Allowance.
U.S. Appl. No. 13/618,455, Mail Date May 13, 2015, Issue Notification.

* cited by examiner

*Primary Examiner* — James Lin
*Assistant Examiner* — Ho-Sung Chung
(74) *Attorney, Agent, or Firm* — Workman Nydegger; John Kwok

(57) ABSTRACT

Systems and methods for electropolishing devices are disclosed. The electropolishing system includes electropolishing fixtures configured to reposition the devices during the electropolishing process.

18 Claims, 11 Drawing Sheets

ELECTROPOLISHING METHOD INCLUDING MULTI-FINGER CONTACTS

BACKGROUND OF THE INVENTION

Medical devices are an important part of the health industry and are responsible for improving the health of many people. Many life-saving procedures can be performed today because of advances in medical device technology. Stents, for instance, are examples of medical devices that are used in a variety of medical procedures. When stents are used in the context of the vascular system, they can open blocked vessels, increase the flow of blood and prevent reoccurrence of the blockage. Stents are not limited, however, to the vasculature system and can be employed in many systems and circumstances.

The production of medical devices such as stents can be a complicated process. Producing the stent includes forming struts that are arranged to provide strength and flexibility to the stent. The struts can be formed, for example, by laser cutting.

Once the stent is formed, the stent is polished in order to remove rough edges that may remain on the stent and to smooth the surface of the stent. As one can imagine, a stent with rough edges may have adverse effects if introduced into a patient's vasculature. The stent could cut a vessel's wall, for instance, or irritate the vessel's wall, stimulating cell growth and forming a blockage in the vessel.

Electropolishing is the process commonly used to polish stents. The process requires that the device be suspended within an electrolytic bath while electrical current is applied through the stent in order to drive material away from the stent surface. Forming a secure contact is important to the process since insufficient current flow results in improperly or poorly polished devices. Alternatively, the lack of a secure contact can result in electrical arcing that burns the stent's surface.

Conventionally, the electrical contact has been accomplished using paddles. The use of paddles has not always been effective. The results produced with traditional paddles are not optimal, either because the paddles cover too much surface area or because the paddle contacts cannot be alternated to allow for stent contact areas to vary. There is a need for a new configuration that allows contact with the stent surface to be achieved and effectively controlled in order to achieve a more uniform finish.

BRIEF SUMMARY OF THE INVENTION

Embodiments relate to electropolishing fixtures or systems and to methods for electropolishing devices such as stents or other medical devices. The electropolishing fixtures and methods electropolish a device or stent by rotating the stent. Electrical contact is maintained between the stent and an electrode during the electropolishing process. Some embodiments establish electrical contact between an inner surface of the device and an anode that passes through a lumen of the stent. Other embodiments establish electrical contact with an outer surface of the stent. By repositioning the stent or by rotating the stent during the electropolishing process, the electrical contact points between the stent and the anode are changed and the stent is more evenly polished.

In one example, an electropolishing fixture includes lever arms. The lever arms can be actuated by a controller. The lever arms each have a distal end and a proximal end. The proximal ends are typically connected to a linkage adapted to move the lever arm in multiple directions or planes and/or about multiple axes (which may change locations). The distal ends are configured to contact the stent. Once contact is established, the movement of the lever arms are controlled such that the distal end rotates the stent about a mandrel (which may or may not be a conductive electrode) passing through a lumen of the stent. The lever arms can be controlled and moved individually or in groups or as a whole. In this example, the electrical contact is established with an inner surface of the stent although the lever arms can also be configured to establish electrical contact with an outer surface of the stent.

In another example, the electropolishing fixture may include a pair of rollers that cooperate with a plate anode to electropolish one or more stents. A stent (or more than one) may be loaded by placing the stent on the rollers. The plate anode is then arranged to position the stent between a surface of the plate anode and the rollers. The stent may be slightly compressed to ensure electrical contact between the plate anode and the stent and to avoid slippage during rotation of the stent. The stent is rotated by rotating the rollers and moving the plate laterally. Alternatively, the plate anode may be replaced by a roller anode that rotates in sync with the other rollers.

These and other advantages and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 1:
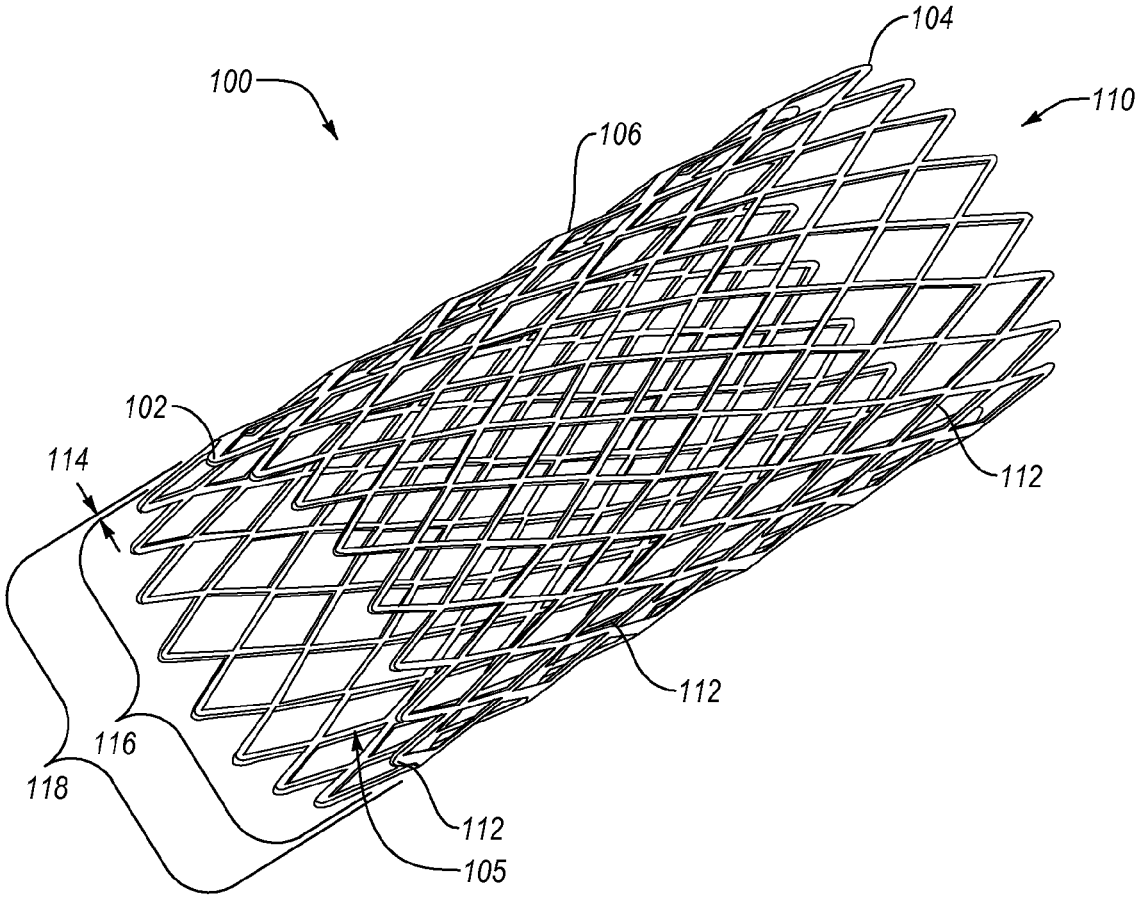
FIG. 1 illustrates a perspective view of a stent, which is an example of a medical device.

Embodiments of the invention relate to an electropolishing system that may include one or more electropolishing fixtures. Each electropolishing fixture may be configured for electropolishing devices including medical devices. Embodiments of the invention include a repositioning assembly configured to reposition a device such as a stent during an electropolishing process.

Embodiments of the electropolishing fixtures include lever arms configured to reposition a device relative to a mandrel or electrode. The lever arms may also press against the device during the electropolishing process to ensure adequate electrical contact.

The lever arms may be electrically conductive and carry electrical current to the area of contact, or they may be formed of an insulating material. In the latter case, the lever arms of the electropolishing fixture are operative to apply pressure to establish electrical contact between the device and another conductive feature (e.g., an electrode or conductive mandrel).

Embodiments of the invention are discussed in the context of a stent, which is an example of a medical device. Embodiments of the invention are applicable to electropolishing of other devices as well.

When electropolishing a device such as a stent, the stent is placed over a mandrel, which may be conductive, and submerged in an electrolytic bath. The mandrel may be connected with an electrode contact or may be configured as an electrode. Alternatively, the mandrel may be non-conductive or not configured to deliver electrical current to the stent.

When the mandrel is conductive (e.g., an anode) the lever arms of the electropolishing fixture press the stent against the conductive mandrel to ensure an electrical contact therebetween. In addition to ensuring contact, the lever arms may be used to drive rotation of the stent or more generally to reposition the stent during the electropolishing process relative to the anode. As discussed in more detail herein, the stent benefits from being rotated or repositioned while immersed within an electrolytic bath because the contact points between the stent and the anode change.

In addition, the ability to reposition the stent while the stent is immersed results in less exposure to oxygen. For example, in electrolytes containing water, oxygen bubbles may form on the surface of the stent during electropolishing. If these bubbles remain adhered to the stent surface, they prevent the surfaces of the stent under the bubbles from being effectively electropolished. If the stent is rotated or repositioned, then these bubbles may be washed away/removed from these stent surfaces and the effective electropolishing of these surfaces may proceed. As a result, repositioning the stent results is less exposure to oxygen and improves the resulting finish of the stent's surface.

Once the stent is loaded on the anode, the stent need not be in contact with the anode, or the stent may lightly contact the anode due to its own weight. The anode, for example, may be smaller than the lumen of the stent such that the stent fits loosely on the anode. In order to achieve a more secure contact between the stent and the mandrel, the lever arms of the fixture press against the stent such that the stent is pressed against the anode.

The electropolishing fixture may include lever arms as previously stated that may be configured to both establish electrical contact between the stent and the anode and to reposition the stent during the polishing process. The lever arms may be laterally spaced relative to each other, and may be capable of advancing toward, and retracting from, the stent surface. In one embodiment, the lever arms may be moved individually, or the lever arms may be moved in unison. The lever arms may be separated from one another or, alternatively, the lever arms may be interconnected to form a single unitary body. In the latter case, manipulation of the fixture results in movement of all of the lever arms together.

As described in more detail herein, movement of the lever arms may occur in multiple planes and about multiple axes. The lever arms may move perpendicularly to a stent axis, rotate about a hinge point (which may bring the lever arms into contact with the stent), move laterally to the stent, or the like or any combination thereof. More generally, the lever arms may move in any direction, plane, or path to bring the lever arms into contact with the stent and to reposition the stent.

When the lever arms contact the stent, the lever arms may be moved as necessary in order to produce stent rotation about the anode. For example, the lever arms (or a portion thereof) may initially rotate about a hinge point until the distal ends of the lever arms press against the stent. Next, the lever arms may move laterally in a direction that is tangential to the stent's outer surface. The friction between the lever arms and the stent in combination with lateral or tangential movement of the lever arms cause the stent to rotate about the anode. During rotation of the stent, individual lever arms may be rotated into and out of contact with the stent's surface, allowing for the stent surface to be more uniformly polished.

In an alternative example, the stent may be positioned over a conductive mandrel and brought into contact with rollers or bars. These rollers or bars may be mounted on the lever arms (e.g., on distal ends on the lever arms either in a parallel or transverse manner), such that movement of the lever arms brings the rollers into contact with the stent and the stent into contact with the anode. Alternatively, the lever arms may press the stent against both the mandrel and the rollers. The rollers, which may also be configured to rotate, may advantageously reduce friction on the stent surface during rolling, which will help prevent damage to the stent. Alternatively, there may be no need for rollers and the stent may simply be rolled against a flat plate, for example. In either case, the stent is rotated or repositioned during the electropolishing process, which improves the resulting surface finish.

During the electropolishing process, electrical contact can be established with the inner surface of the stent and/or the outer surface of the stent. The mandrel or anode, for example, may be conductive and produce an electrical connection when the lever arms and/or rollers press the stent against the anode. The lever arms may also or alternatively be conductive to establish an electrical connection with an outer surface of the stent.

In another embodiment, stents can be polished using a plate anode in combination with insulated rollers. The stent is placed on the rollers and the plate anode is then placed on the stent such that the stent is secured between the plate anode and the rollers. As the plate anode is moved laterally or tangentially with respect to the stent and while electrical contact is maintained, the rollers rotate in a corresponding manner. This results in rotation of the stent during the electropolishing process.

In addition, the plate anode can also be shielded in order to control current flow and improve polishing. By shielding the anode and/or the cathode, the current flow between the cathode and the anode is through the area occupied by the stent. This provides more controllable and more consistent results.

FIG. 1 illustrates a perspective view of an example medical device 100 and is referred to herein as a stent 100. The stent 100 includes a body 110 that is generally tubular in shape, although other shapes and configurations are contemplated. The stent 100 has a first end 102 and a second end 104 that oppose each other. The body 110 includes struts 106 that are arranged to provide, by way of example only, strength and flexibility to the stent 100.

The stent 100 may also have a thickness 114, an inner diameter 116 and an outer diameter 118. The difference between the inner diameter 116 and the outer diameter 118 defines the thickness 114 of the stent 100. Embodiments of the invention can more evenly polish the stent 100 such that at least some dimensions, such as the thickness 114 of the body 110 or the dimensions of the struts 106 are more uniform. The stent 100 also includes a lumen 105 that may be defined by an inner surface or inner diameter 116.

The stent 100 may be made of a material or alloy, including, but not limited to, Nitinol, stainless steel, cobalt chromium, or the like. The stent typically has certain characteristics that facilitate operation of the stent. Some embodiments of the stent 100 (e.g., a stent formed of Nitinol) may be deformed (e.g., bent, compressed, expanded, or the like) by a force. When the force is removed, the stent 100 returns to its original shape. The elasticity and deformability of the stent 100 aid in the deployment of the stent 100 as well as in the operation of the stent 100.

While manufacturing the stent 100, the formation of the struts 106 or of the ends 102, 104 can often results in edges 112 or other areas that are rough or unsmooth. In addition, the thickness 114 may not be uniform and the inner surface and/or outer surface of the stent 100 may be rough.

Electropolishing the stent 100 smoothes the edges 112 as well as the surfaces of the stent 100. Polishing the stent 100 may prevent the stent 100 from having problems during deployment and from causing problems to the vasculature or tissue once deployed. Electropolishing the stent 100 may also make the dimensions of the stent (thickness, strut dimensions, etc.) more uniform.

Figure 2:
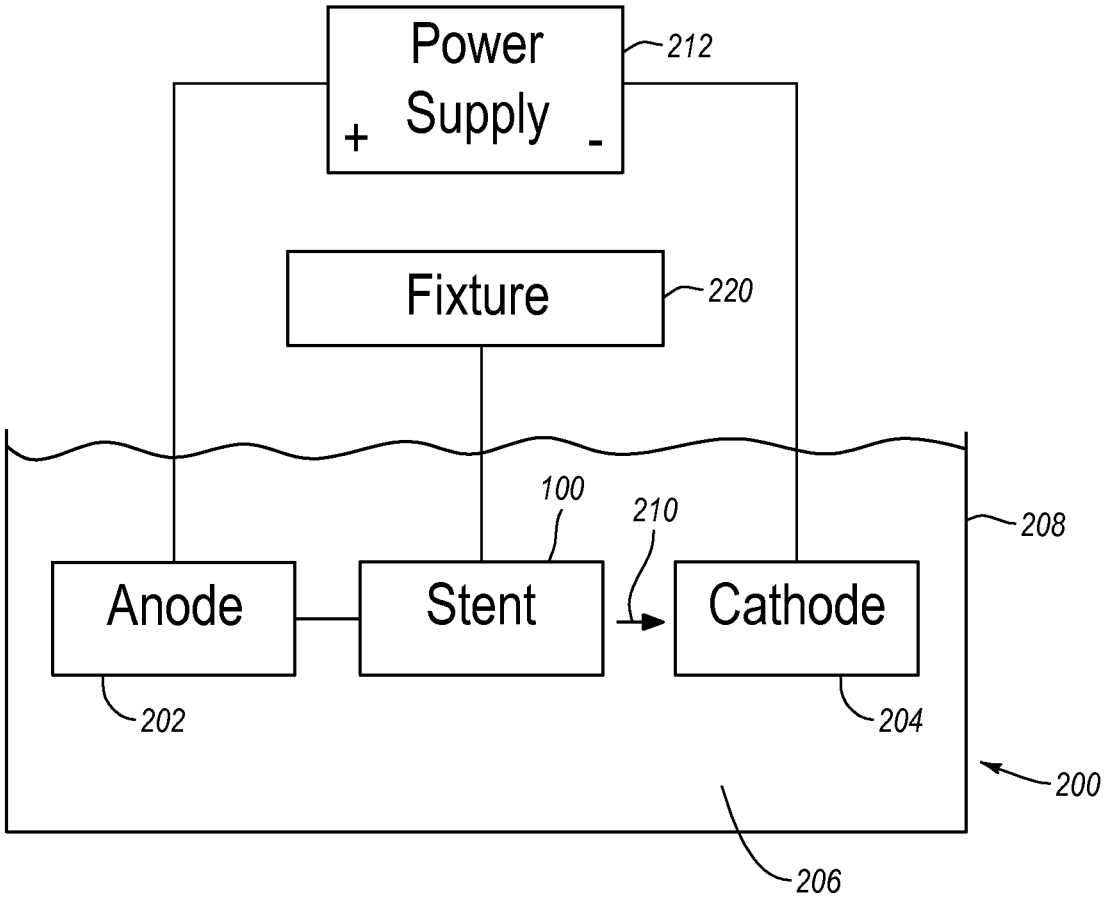
FIG. 2 is a functional block diagram of a system that includes an electropolishing fixture for electropolishing devices such as stents.

FIG. 2 illustrates a block diagram of an example system 200 for electropolishing the stent 100 or other device. The system 200 includes a container 208 that holds an electrolytic bath 206. The system 200 electropolishes the stent 100 in the electrolytic bath 206 once the stent 100 is loaded on a fixture 220 (or on a mandrel/anode), immersed in the electrolytic bath 206 and the electropolishing power supply 212 is turned on.

During the electropolishing process, the stent 100 is usually fully immersed in the electrolytic bath 206 along with an anode 202 and a cathode 204, which are electrically connected to the positive and negative terminals of the electropolishing power supply 212. The anode 202 and the cathode 204 may be part of or separate from the fixture 220. Prior to immersion in the electrolytic bath 206 or after immersion in the electrolytic bath 206, the stent 100 is positioned (e.g., by the fixture 220) such that the stent 100 comes into electrical contact with the anode 202. The electrical contact may be initially established by gravity. However, the fixture 220 operates to establish adequate electrical contact.

The fixture 220 may include lever arms that press the stent 100 against the anode 202 when the stent is immersed in the bath 206. The fixture 220 may be configured such that the stent 100 can be removed from and immersed in the electrolytic bath 206. For example, the stent 100 may be loaded on the anode 202 outside of the electrolytic bath 206 and then immersed for the electropolishing process.

Once the stent 100, the anode 202 and the cathode 204 are immersed in the electrolytic bath 206, the electropolishing power supply 212 is turned on and/or its terminals brought into electrical contact with both the anode 202 and the cathode 204. As a result, a current 210 (e.g., charged stent metal ions) flows from the stent 100 toward the cathode 204 through the electrolytic bath 206. In this manner, the stent 100 is electropolished.

More specifically, electropolishing uses electrochemically driven reactions to remove material from a surface of the stent 100 by forming positively charged stent metal ions that go into solution in the electrolytic bath 206. Electropolishing tends to remove stent material at a greater rate from a stent portion that has increased electrical current densities. Portions of the stent's surface that are rough (the protruding portions of bumps, shards, sharp edges, etc.) tend to have higher electrical current densities and are thus removed at a greater rate than flatter surfaces during the electropolishing process. The surface of the stent 100 is smoothed and polished by this preferential removal of material from the stent's surface.

The fixture 220 included in the system 200 is configured to position the stent 100 and/or reposition the stent 100 within the electrolytic bath 206. The fixture 220 can be controlled automatically and/or manually to position the stent 100 within the electrolytic bath 206 and reposition the stent 100 relative to the anode 202. The fixture 220 may be immersed wholly or partially within the container 208 and/or the electrolytic bath 206. The fixture 220 may be configured to be at least partially placed into and lifted out of the electrolytic bath 206 and/or the container 208.

During the electropolishing process performed in the system 200, the stent 100 is typically in contact with an electrode such as the anode 202 as previously stated. As a result, the anode 202 establishes electrical contact points between the anode 202 and the surface of the stent 100. The fixture 220 ensures that contact points exist between the anode 202 and an inner surface of the stent 100, although embodiments contemplate examples where the contacts points are located on the outer surface and/or inner surface of the stent. The anode 202 can be configured with one or more locations that are configured to contact the stent 100 (e.g., establish an electrical contact) and the contact points between the anode 202 and the stent 100 can be on an internal surface of the stent 100 and/or an external surface of the stent 100. Alternatively, the anode 202 may have a loose fit and the fixture 220 ensures that contact between the anode 202 and the stent 100 is established during the electropolishing process.

Current from the positive terminal of the electropolishing power supply 212 is supplied to the stent 100 through the anode 202. The cathode 204 is electrically connected to the negative terminal of the electropolishing power supply 212 and thus an electrical circuit/path is created to the positive terminal via the anode 202, the stent 100 and the electrolytic bath 206. As a result, the current 210 (positively charged stent metal ions) flows toward the cathode 204 through the electrolytic bath 206. Current flow from the surface of the stent 100 is facilitated in this manner in order to remove material from the stent and thereby smooth the stent surface during the electropolishing process.

Contact points or more generally contact regions corresponding to the locations of contact between the stent 100 and the anode 202 have little or no current flow from the stent surface into the electrolytic bath 206. As a result, the contact points or contact regions are not well smoothed or polished in conventional systems or are not smoothed or polished at the same rate as other areas of the stent's surface.

The fixture 220 is configured to position (or reposition) the stent 100 to establish the contact regions between the stent 100 and the anode 202. In addition, the fixture 220 is configured or can be operated such that the stent 100 may be repositioned over time. As a result of being repositioned (e.g., rotated), the contact regions between the stent 100 and the anode 202 change during the electropolishing process and the overall finish of the stent 100 is thereby improved. When the contact regions are exposed after repositioning the stent 100, current 210 is then able to flow from the previous contact regions into the electrolytic bath 206 and to the cathode 204. As a result, the surface of the stent is more evenly smoothed by automatically and/or manually repositioning the stent 100 during the electropolishing process.

In addition, positioning or repositioning the stent 100 can also result in a stent having better or more uniform dimensions. Repositioning the stent 100 can remove bumps or other portions of the stents' surface that may be rough, such as at contact regions, resulting in more even dimensions.

FIG. 2 thus illustrates the stent 100 positioned on the anode 202 or anode contact. The anode 202 is effective to provide an electrical contact to the stent 100 during the electropolishing process. In addition, the stent 100 benefits from being repositioned while immersed within the electrolytic bath 206.

Figure 3A:
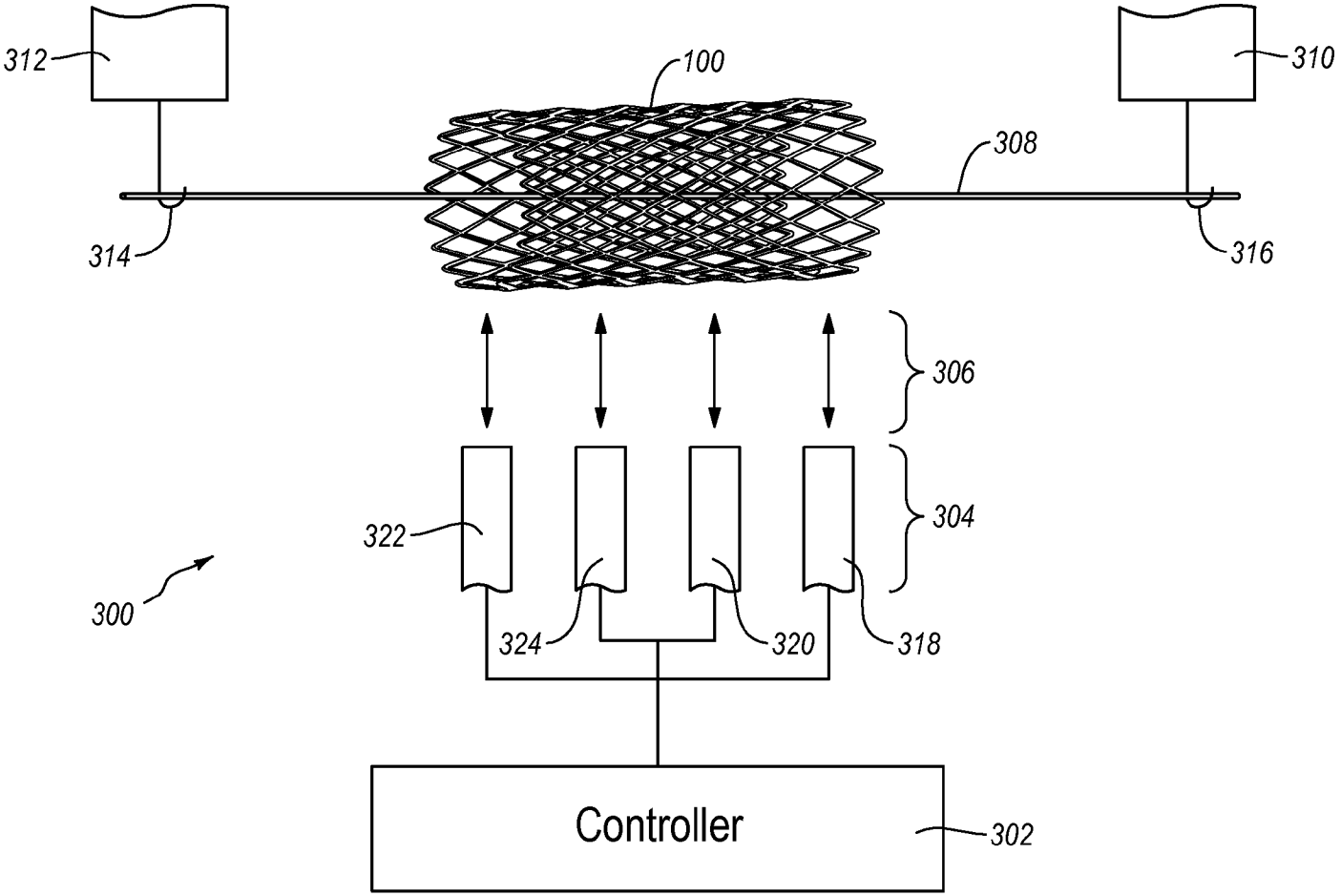
FIG. 3A illustrates an example of an electropolishing fixture for electropolishing devices that includes lever arms configured to reposition the devices during the electropolishing process.

FIG. 3A illustrates a system 300 in which a stent 100 is electropolished. FIG. 3A illustrates the stent 100 loaded on a mandrel, which may also be an anode 308. The anode 308 is removably connected to contacts 314 and 316 on, respectively, posts 312 and 310. The posts 310 and 312 are configured such that sufficient tension is maintained in the anode 308 during the electropolishing process. Electrical current/potential is also supplied to the anode 308 in one example via the posts 310 and 312 from an electrical source.

FIG. 3A illustrates lever arms 304 that are controlled by a controller 302 in this example. The lever arms 304 are an example of a repositioning assembly that can be independently or simultaneously controlled by the controller 302. The lever arms 304 include distal ends 318, 320, 322, and 324. The distal ends 318, 320, 322, and 324 can be moved to be in contact with the stent 100 and/or the anode 308. The distal ends 318, 320, 322, and 324 of the lever arms 304 can press the stent 100 against the anode 308 to establish electrical contact.

In one example, the lever arms 304 can be controlled to act as fingers that may, in sequence, rotate the stent 100. For example, the distal end 322 may be actuated to press against the stent 100 and rotate the stent 100. As the distal end 322 reaches a limit, the distal end 324 may continue rotating the stent 100 while maintaining the electrical contact needed between the stent 100 and the anode 308. This process may continue using each of the lever arms 304 in sequence. Alternatively, more than one of the lever arms 304 may be involved in rotating the stent 100. For example, the distal ends 322 and 324 may be one group and the distal ends 318 and 320 may be another group. These groups of lever arms may take turns rotating the stent 100. The stent 100 can be rotated in either direction by distal movement or proximal movement of the lever arms 304 as illustrated by the arrows 306.

Figure 3B:
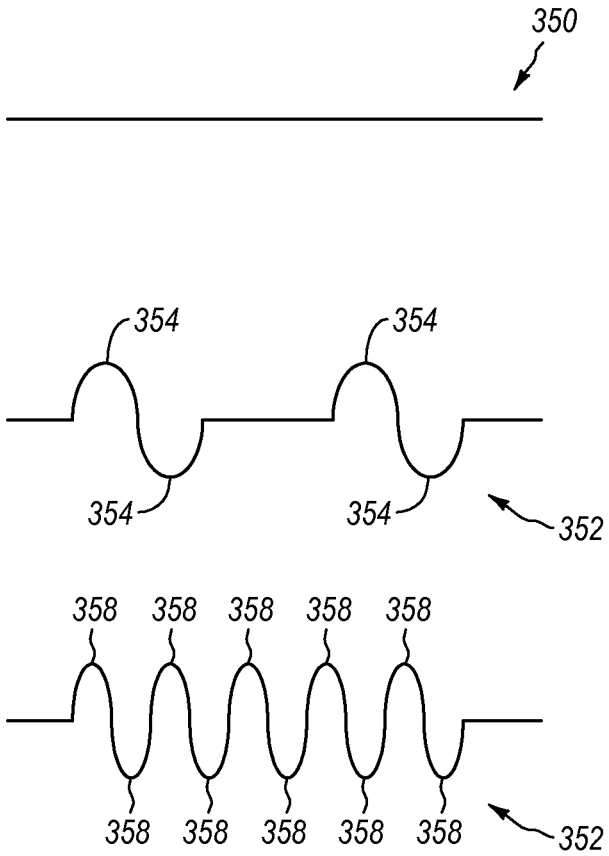
FIG. 3B schematically illustrates various possible configurations of conductive anodes that may be used in an electropolishing system.

FIG. 3B illustrates examples of an anode. The anode used in the electropolishing process may be an anode 350, an anode 352, and an anode 356. The anode 350 may be a wire that has a loose fit inside the lumen of the stent 100. The anodes 352 and 356, however, have curves and may have a friction fit with a surface of the stent or more specifically with an inner surface of the stent 100. The anode 352 may have contact points 354. The anode 356 may have comparatively more contact points 358. The shape of the anode can vary and may have either a loose fit or a fit that ensures electrical contact in the absence of external pressure on the stent 100.

When the anode 350 is used, the lever arms 304 may press the stent 100 against the anode to establish and maintain electrical contact. When anodes such as the anodes 352 and 356 are used, the lever arms 304 are configured to rotate the stent. As a result of the configuration of the anodes 352 and 356, the lever arms 304 are not required to be in continuous contact with the stent 100 in this example.

In addition, the distal ends 318, 320, 322, and 324 of the lever arms may be configured with features that grip the stent to facilitate rotation with minimal force, thereby reducing the risk of damaging the stent. The features may include teeth, brush-like bristles, waves, texture, or the like or any combination thereof. The features may also be compressible or spongelike. The features are configured to aid in rotating the stent with minimal pressure in order to minimize any potential damage to the stent's surface.

Figure 4:
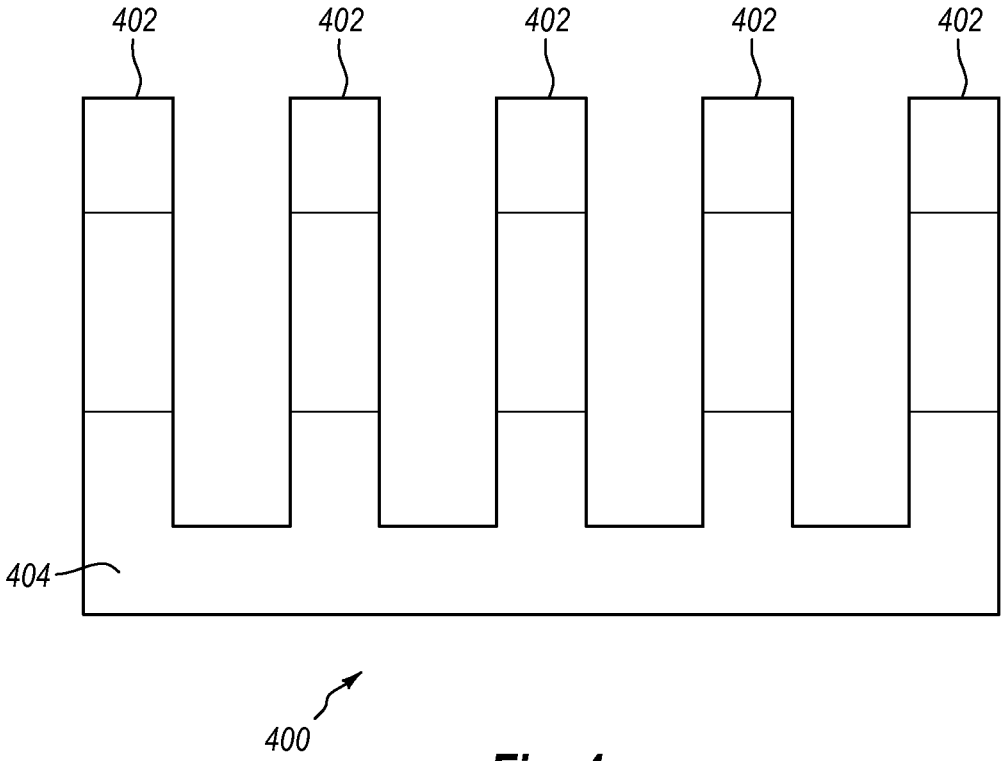
FIG. 4 schematically illustrates an example of integrated lever arms.

FIG. 4 illustrates another example of a lever arm 400. The lever arm 400 includes an integrated body or base 404. The distal ends 402 separate or extend from the base 404 separately. In this example, each of the distal ends 402 move in unison. The lever arm 400 can be moved, however, in a manner that ensures constant contact with the stent, periodic contact, or the like. Once contact is established, the lever arm 400 may move tangentially back and forth to rotate the stent and maintain electrical contact between the stent 100 and the conductive mandrel or anode.

Figure 5A:
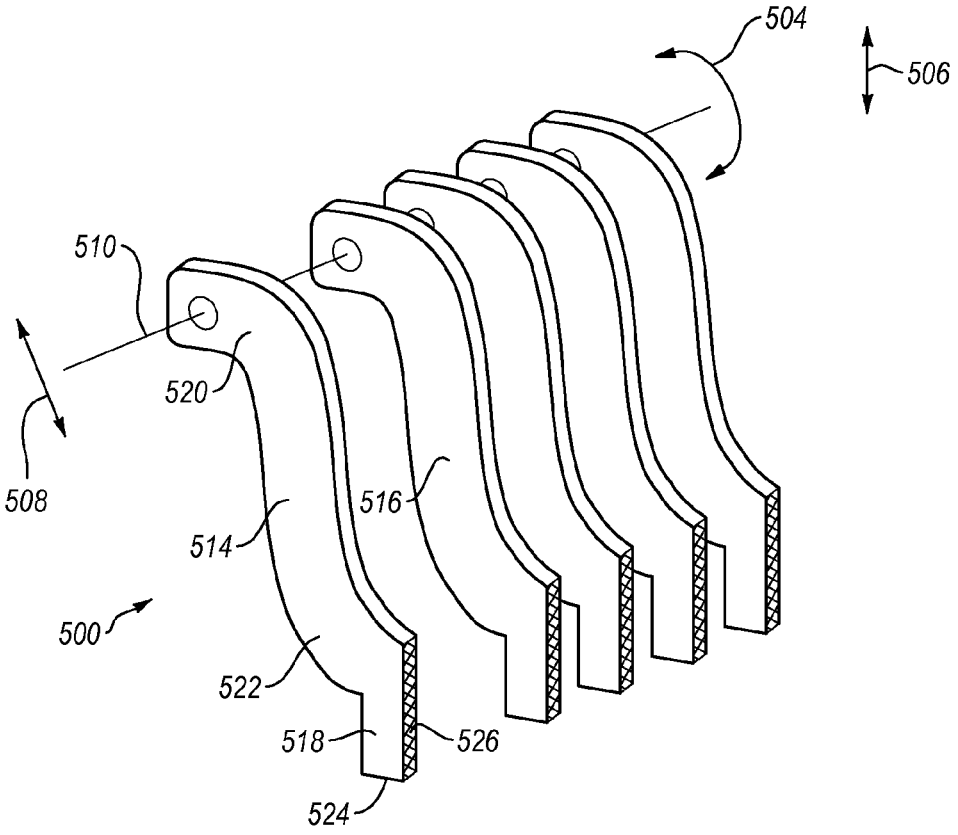
FIG. 5A illustrates an example of individually controllable lever arms configured for repositioning devices during an electropolishing process.

FIG. 5A illustrates examples of lever arms in an electropolishing fixture. FIG. 5A also illustrates movement of the lever arms 500 included in an electropolishing fixture. The lever arms 500 can each be controlled independently, in groups, or all together. The groups of lever arms may, but need not, be contiguous.

The lever arms 500 may each have a similar shape, such as a shape of a lever arm 514. The lever arm 514 may include a distal end 518 configured to press against a device during an electropolishing process. The lever arm 514 may also have a proximal end 520. A body of the lever art 514 extends between the proximal end 520 and the distal end 518. The body of the lever arm 514 may have a curve or a bend 522 that can be located at any point between the distal end 518 and the proximal end 520. A length of the distal end 518 between a tip 524 and the bend 522 is sufficient to allow the lever arm 514 to rotate the stent while a surface 526 of the distal end 518 is in contact with the stent.

The lever arm 514 and the lever arms 500 may be configured such that the distal end keeps in contact with the stent when the lever arm 514 is rotated distally to contact the stent and then moved tangentially while in contact with the stent.

The electropolishing fixture is configured to move the lever arms 500 in multiple directions including in a rotational direction 504 about an axis 510, back and forth in a horizontal direction 508 (e.g. lateral or tangential to the stent) and up and down in a vertical direction 506 (e.g., perpendicular to an axis of the stent). Each of the lever arms 500 may have its own linkage to an actuator that enables each of the lever arms 500 to be moved in one or more of the directions 504, 506, and 508 individually or in unison or in groups.

FIG. 5A further illustrates the lever arm 514 in an extended position, which may be a position in which the lever arm 514 is in contact with a stent. In this example, the lever arm 514 has been rotated about the axis 510 such that a distal end of the lever arm 514 is in contact with the stent and with sufficient pressure to establish adequate electrical contact.

The lever arm 514 may then be controlled to move or rotate the stent. The lever arm may move laterally in the direction 508 to rotate the stent. At some point in the electropolishing process, the lever arm 516 may be actuated to contact the stent, for example by rotating about the axis 510 to press against the stent. Once sufficient contact is established between a distal end of the lever arm 516 and the stent 100 to maintain the electrical connection between the stent and the anode, the lever arm 514 may be retracted from the stent. The rotation of the stent is then performed by the lever arm 516, which may move tangentially relative to the stent in order to rotate the stent. In this manner, the lever arms 500 can be actuated to successively rotate the stent. Each of the lever arms 500 may have an opportunity to rotate the stent 100. When the lever arms 500 are positioning, the lever arms 500 may move in one or more of the directions 504, 506, and 508. By successively using the lever arms 500 to rotate the stent, the stent 100 is not only rotated but the contact points may also change. This may enhance the ultimate finish of the stent 100.

Figure 5B:
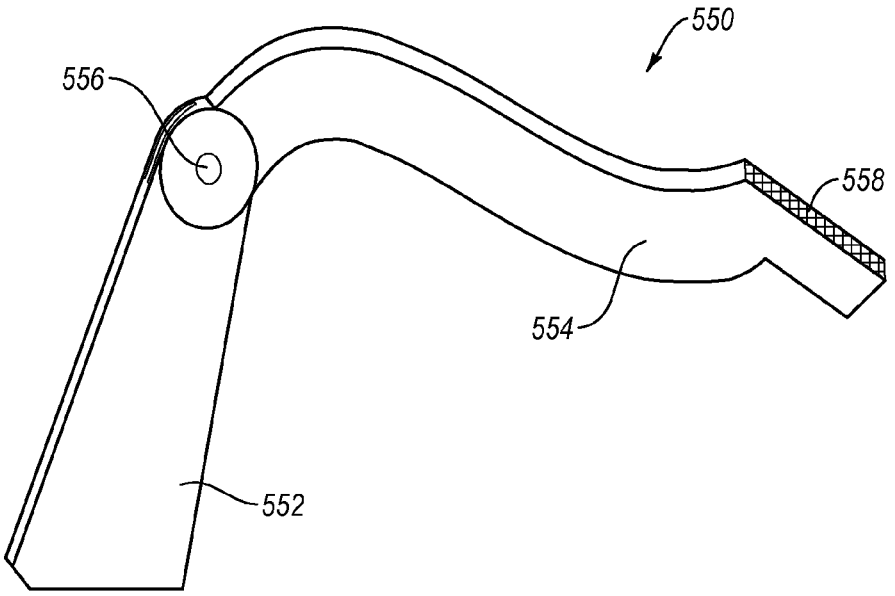
FIG. 5B illustrates an alternative example of an individually controllable lever arm.

FIG. 5B illustrates another embodiment of a lever arm. FIG. 5B illustrates a lever arm 550 that includes a joint 556. The joint 556 enables a distal end 554 to be moved independently of a proximal end 552. The distal end 554 can be controlled pneumatically, electrically, or the like. The inclusion of the joint 556 makes the lever arm 550 more fingerlike and may enable rotation to be achieved in a smaller space. The textured surface 558 can be placed against the stent.

The lever arms 500 (as well as the lever arm 550) can, as previously discussed, be moved in multiple planes and about multiple axes. In addition, the axes may change. As the lever arm 514 moves in the direction 508, the axis 510 may also move. The lever arms 500 may rotate about a hinge point (e.g., the axis 510) until the distal ends of the lever arms contact the stent or press the stent against the anode to establish an electrical contact. At that point, the lever arm may move laterally or tangentially with respect to the stent's outer surface. In this manner, the lateral or tangential movement causes the stent to rotate about the anode while maintaining electrical contact between the stent and the anode. In a case where the anode is a non-conductive mandrel, the lever arm may be configured to deliver current to the stent via the outer surface of the stent.

The friction and/or mechanical interference forces between the distal ends of the lever arms 500 and the stent must exceed the friction and/or mechanical interference forces between the stent and the anode to cause the stent to rotate about the anode. The surface of the distal ends of the lever arms 500 may thus be configured with features to aid the lever arm to grip (create a mechanical interference with) the stent and/or increase the friction between the lever arm and the stent. The features may include teeth, ridges, texture (e.g., brush-like bristles), a softer surface that may elastically deform around a stent strut, or the like as previously described. Additionally, the material of the surface of the distal ends of the lever arms 500 may be selected to have a higher coefficient of friction than other material choices that may also withstand the electrolytic bath (for instance, PVDF [Kynar] may be chosen over PTFE [Teflon]). During rotation, the individual lever arms (e.g., in sequence) may be brought into and out of contact with the stents surface as previously described. This can improve the polish of the stent and make the polish more uniform. Some embodiments therefore allow for the stent to be rotated (or more generally repositioned) during the electropolishing process and for different areas or portions of the stent's surface to be contacted by the lever arms 500 and by the anode at different times.

Figure 6A:
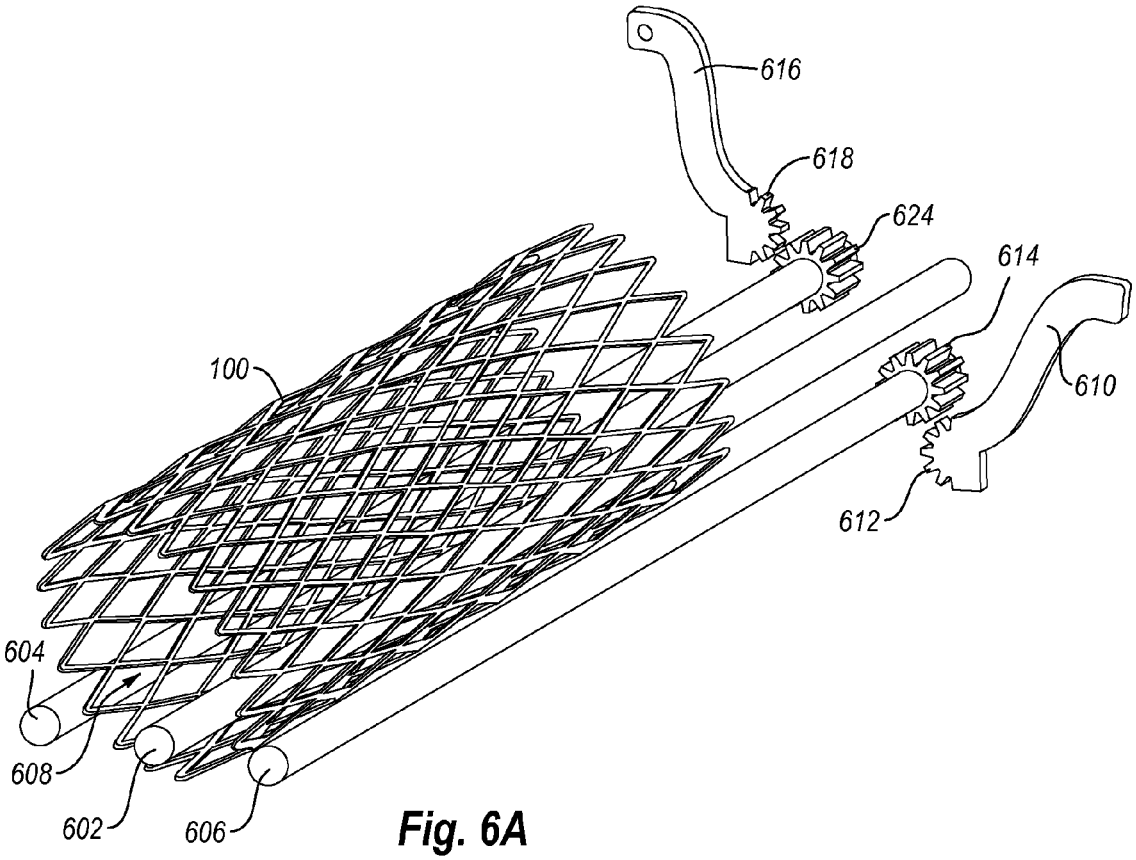
FIG. 6A illustrates and example of rollers configured for repositioning a stent during an electropolishing process.

FIG. 6A illustrates another example of a lever arm, which can be arranged in a group of lever arms, that cooperate with roller bars to rotate or reposition a stent. The lever arms 610 and 616, which are examples of the lever arms disclosed herein, are actuated to rotate rollers 604 and 606, which rollers 604 and 606 press the stent against an anode 602. In FIG. 6A, the pair of rollers 604 and 606 are oriented in a direction of an axis of the stent 100 and may be parallel to the anode 602. The rollers 604 and 606 may be located on or are configured to engage with a distal end of the lever arms 616 and 610. The rollers 604 and 606 are configured to press against the outer surface of the stent such that electrical contact is established between the stent 100 and the anode 602. The rollers 604 and 606 are further configured to rotate while in contact with the stent 100. Rotation of the rollers 604 and 606 (or rotation of one of the rollers 604 and 606) results in rotation of the stent 100 while keeping the stent 100 in contact with the anode 602.

In one example, the roller 606 has a cog 614 mounted on one end and the roller 604 has a cog 624 mounted on one end. The rollers 604 and 606 can be rotated by, respectively, lever arms 616 and 610. A distal end 618 of the lever arm 616 engages the cog 624. Movement of the lever arm 616 is converted to rotation of the roller 604. Similarly, a distal end 612 of the lever arm 610 engages with the cog 614 to rotate the roller 606. In one example, only one of the rollers 604 or 606 is driven.

Movement of the lever arms 610 and 616 can thus rotate the stent 100 about the anode 602 while the anode 602 is in electrical contact with the stent 100. The distal end 612 may include teeth to engage the cog 614. Alternatively, the distal end 612 may simply frictionally engage the cog 614. In this example, the coefficient of friction between the lever arm 610 and the cog 614 is stronger than the friction between the anode 602 and the stent 100.

Figure 6B:
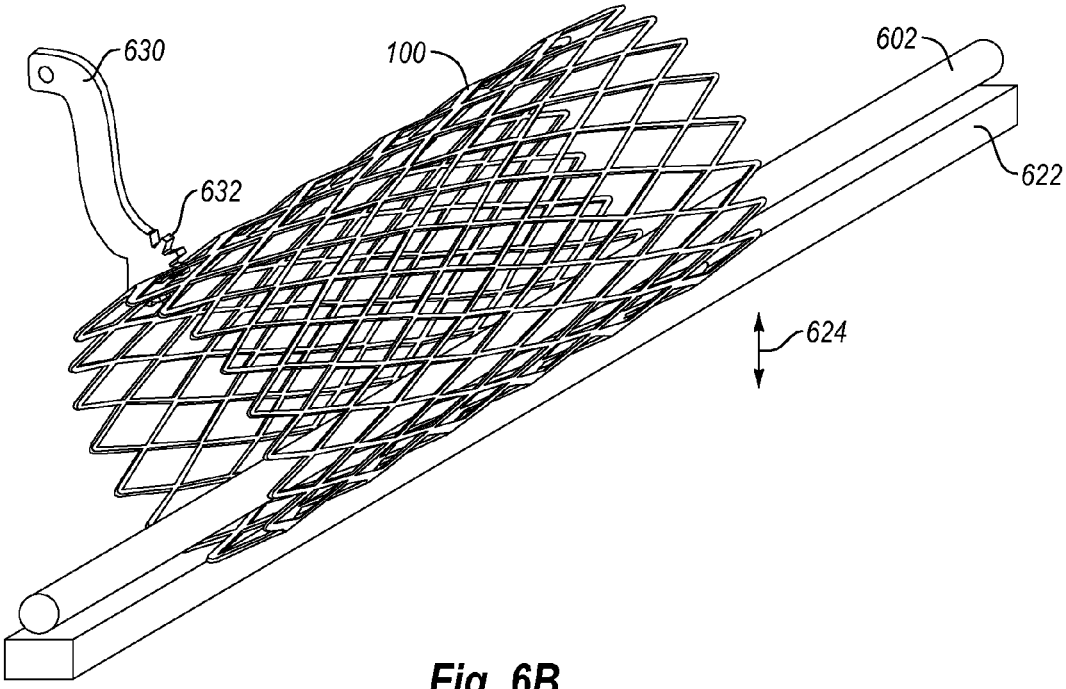
FIG. 6B illustrates an example of a bar used during an electropolishing process.

FIG. 6B illustrates an alternative arrangement where a lever arm cooperates with a bar to rotate the stent. In this example, a bar 622 is pressed against the stent. The bar 622 can be moved in a direction of an arrow 624 to press the stent 100 against the anode 602 or to release the stent 100. During an electropolishing process, the bar 622 is moved away from the stent 100 and the lever arm 630 is actuated to rotate the stent. The bar 622 is then moved back to press against the stent 100 against the anode 602 and the electropolishing process resumes. In one example, current is disconnected while the stent 100 is repositioned. In this example, the lever arm 630 (or a plurality of lever arms) are controlled to reposition the stent. The lever arm 630 includes a surface 632 configured as described herein that can be placed on the outer surface of the stent in order to reposition the stent 100.

Alternatively, the lever arms may be configured to press the stent, or more specifically an outer surface of the stent, against a flat anode plate. Once the stent is pressed against the plate anode, lateral movement of the fingers may roll the stent against the plate anode. In this example, electrical contact may be established through the outer surface of the stent 100.

Figure 7A:
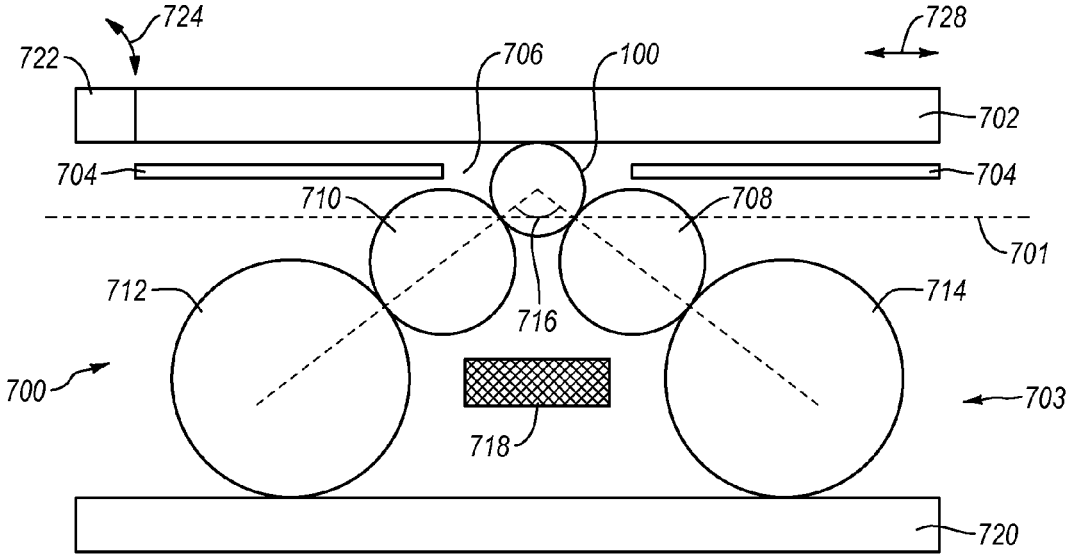
FIG. 7A illustrates an example of a system for electropolishing devices that includes a plate anode cooperating with rollers to reposition the devices being electropolished.

FIG. 7A illustrates another example of a system for electropolishing a device or for simultaneously electropolishing multiple devices or stents. The system 700 is immersed in the electrolytic bath 703 at least to a depth 701 to cover at least a portion of the stent 100. However; in some embodiments, the stent 100 may be completely immersed. In some embodiments, the system 700 is oriented in the electrolytic bath such that any bubbles generated on the cathode 718 during electropolishing do not rise into the stent 100. As previously discussed, gas bubbles adhering to the surface of a stent interfere with its electropolishing.

In FIG. 7A, the stent 100 is electropolished by a current that is delivered to the stent 100 through its electrical contact with anode 702, which is a plate anode in this example. The stent 100 is positioned between the anode 702 and rollers 708 and 710, which are arranged to support the stent. FIG. 7A illustrates additional rollers 712 and 714 that may also be used during the electropolishing process. Thus, when the stent 100 is loaded in the fixture of FIG. 7A, the stent is captured between the anode 702 and the rollers 708 and 710. In some embodiments, the anode 702 may be lifted or moved away in direction 724 to facilitate the placement (and removal) of the stent 100 from the system 700 and then replaced to capture the stent 100.

The rollers 708 and 710 may be formed of an insulating material that resists erosion in the electrolytic bath. Materials include, by way of example, ceramics such as Zirconia and Silicon Nitride. Other materials such as plastics like Kynar, PTFE and polypropylene may be used. Combinations of these materials may also be used for the rollers 708 and 710 and/or the rollers 712 and 714.

The rollers 708 and 710 may have a diameter that is less than, equal to, or greater than the diameter of the stent 100. The dimensions of the rollers 708 and 710 (and/or rollers 712 and 714) may have an impact on the electropolishing process. More specifically, the rollers 708, 710, 712, and 714 may provide shielding of the anode plate 702 from the cathode 718, for example. As a result, an angle 716 (formed from a center of the stent 100 with sides through centers of the rollers 708 and 710) as well as the dimensions and relative placements of the rollers can be selected to control local stent erosion rate distribution, the force with which the rollers press the stent against the anode 702, or the like or combination thereof. In addition, the rollers 712 and 714 may provide support for the rollers 708 and 710 and, in conjunction with plate 720, may provide rotation for rollers 708 and 710. Plate 720 may also function in conjunction with the rollers 712 and 714 to provide additional shielding of the cathode 718 from the anode 702.

In other words, the placement and/or dimensions of the rollers 708, 710, 712, and/or 714 can be used to control an electric field or to shape a current path between the anode 702 and a cathode 718 as well as between the stent 100 and the cathode 718. In one example, the current paths available between the anode 702 and the cathode 718 via the electrolytic bath 703 are made to be significantly longer and narrower than the current paths between the stent 100 and the cathode 718 via the electrolytic bath 703. This ensures that more of the applied current is directed through the stent and improves the efficiency of the electropolishing process. In addition to the configuration of the rollers 708, 710, 712, and/or 714, the cathode 718 can also be placed and/or shaped in a manner that aids in controlling the electropolishing process. The placement of the cathode 718 may depend on current and voltage considerations, stent configuration, electrolyte composition, or the like. In addition, the cathode 718 may include multiple cathodes 718.

The rollers 708, 710, 712, and/or 714 may be driven (rotated) by a gear arrangement, which may be protected from the electrolytic bath, or by the driven motion of plate 720, in conjunction with the motion of anode plate 702. Driving the rollers 708, 710, 712, and/or 714 with a gear arrangement or by plate 702 in conjunction with the controlled motion of anode plate 702 can provide a controllable motion that can cause the stent to rotate in a controlled manner. The rollers 708, 710, 712, and/or 714 may also be fixed in position, but free to rotate, (for example, the roller ends of one or more of the rollers 708, 710, 712, and/or 714 may be adapted to mount into ceramic or Teflon bearings) while the plate anode 702 may be allowed to move relative to the rollers 708, 710, 712, and 714. Thus, the plate anode 702 may press against the stent 100 during the electropolishing process and move tangentially to the stent's surface to cause the rotation of stent 100.

More specifically, rotation of the stent 100 can be achieved by moving the plate anode 702 in a tangential direction indicated by the arrow 728 and/or by rotating the rollers 708, 710, 712, and/or 714 either by a gear train or by the motion of plate 720. In one example, the lateral or tangential motion of the plate anode 702 is coordinated with the rotation of the rollers 708 and 710 to achieve smooth stent rotation and to prevent slippage in order to minimize damage to the stent 100 or to the stent's finished surface. A single motor can be used to control the movement of the plate anode 702 and/or the rotation of the rollers 708, 710, 712, and 714 and/or the movement of plate 720. A single motor can be used, with an appropriate gear train and/or other linkages, to cause the rollers 708 and 710 to have the same surface speed as the speed of the plate anode 702 in the appropriate directions to facilitate the stent's rotation with minimum slippage.

The system 700 may also include an anode shield 704. The shield 704 may be formed of Teflon or other material that is resistant to the electrolytes. The shield 704 may be formed to be larger than the plate anode 702 and may be formed to include a window or gap 706. The shield 704 may be formed such that the anode 702 slides within or upon the shield 704. In such embodiments, the position of shield 704 relative to the positions of rollers 710 and 708 controls the deformation of stent 100 and thus also controls the contact force of the stent 100 against anode plate 702. The gap 706 enables the anode 702 to contact the stent 100 and establish electrical contact. If the anode 702 is immersed in the electrolytic bath 703, the shield 704 can interrupt current flow from the covered portions of the anode 702 directly toward the cathode 718 and thus limit current flow from the anode 702 toward the cathode 718 that does not flow through and electropolish the stent 100 and thus provides a more efficient and controlled stent erosion rate.

The gap 706 may have dimensions such that the shield 704 and the anode 702 can move together during rotation of the stent 100 and still maintain anode 702 electrical contact with the stent 100. Alternatively, the anode 702 may be able to move relative to the shield 704 (e.g., the anode 702 may slide on top of or within the shield 704 and the position of the shield 704 is fixed relative to the position of stent 100). As a result, the dimensions of the gap 706 can be constant in this example and the anode 702 can be in continuous electrical contact with the stent 100 in order to rotate the stent 100 while maintaining electrical contact. The gap 706 can also be sized similarly to the stent 100 in order to further control the current flow or electric field in the electrolytic bath 703.

Figure 7B:
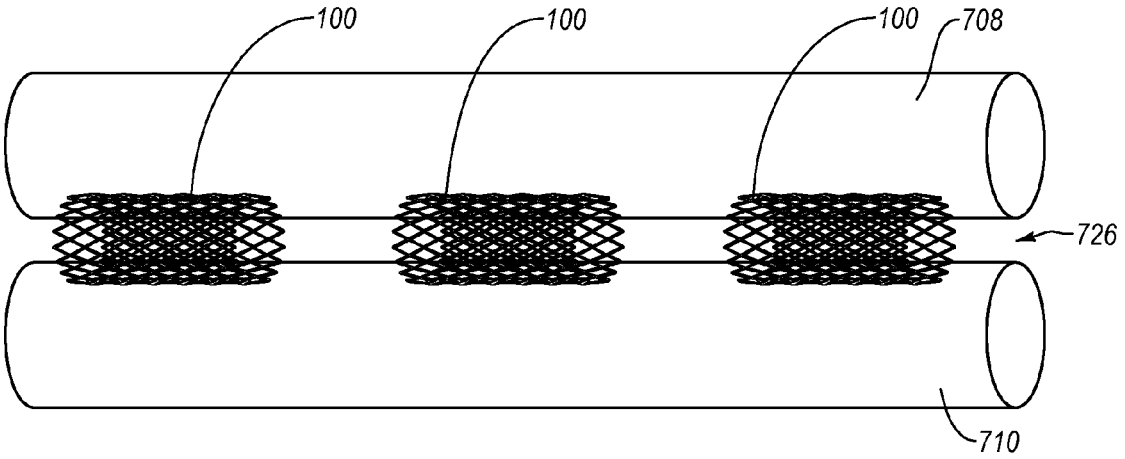
FIG. 7B illustrates a partial top view of the system in FIG. 7A configured to simultaneously polish multiple devices.

FIG. 7B illustrates a top view of the system shown in FIG. 7A and illustrates that multiple stents can be electropolished simultaneously. With reference to FIGS. 7A and 7B, the plate anode 702 may be hinged with a hinge 722 such that the anode 702 can be lifted and rotated out of the way in directions 724 when loading or unloading the stents. In some embodiments, both the shield 704 and the anode 702 may be moved out of the way at the same time and/or comprise an assembly. With the anode 702 lifted, the stents 100 are placed on the rollers 708 and 710. FIG. 7B illustrates that multiple stents 100 or a row of stents 726 can be placed on and supported by the rollers 708 and 710. Once the row of stents 726 are placed, the anode 702 is lowered. In one example, a weight of the anode 702 may be sufficient to establish electrical contact. The anode 702 may be configured to establish a compressive load on the stent 100 or on the row of stents 726 when closed.

In one example, the anode 702 may include rows on plate anodes separated by insulating material. This enables each stent 100 in the row of stents 726 to be associated with its own anode. In addition, cathodes can also be placed in a manner that permits each stent to be associated with, at least primarily, one cathode. As a result, the stents 100 can not only be electropolished simultaneously, but the rate of erosion or other electropolishing factors can be controlled for each stent 100 individually. Current and/or voltage, can be independently controlled for each stent 100, for example, even though all stents 100 are simultaneously polished. The potential or current applied to the cathodes and/or anodes can be different such that the electropolishing process of each stent 100 is different.

The system of rollers can be extended such that multiple rows of stents 726 can be electropolished simultaneously with a single anode 702 (or multiple anodes) and one or more cathodes 718. Each of the rollers 712, 714 may be associated with at least two rows of stents. For example, the roller 712 is used in conjunction with the row of stents 726 and may also be configured to rotate with another row of stents. Alternatively, each row of stents may have its own set of rollers. The various sets of rollers can be configured to accommodate different sized stents.

In one example, the loading/unloading of the electropolishing fixture may occur by first withdrawing or opening the plate anode 702. If hinged with the hinge 722, the anode plate 702 can be lifted. If in a slotted arrangement, the anode plate 702 can be slid to uncover the rollers 708 and 710. Polished stents (if stents were being polished) can then be removed from the rollers 708 and 710 and unpolished stents can be loaded onto the rollers 708 and 710. The plate anode 702 is then replaced to cover/compress the stents 100 between the plate anode 702 and the rollers 708 and 710 such that the stents 100 are each in contact with the plate anode 702. Sufficient contact may be ensured, for example, by slightly compressing the stents 100 when closing the plate anode 702.

In one example after the stents 100 are loaded, the orientation of the loaded fixture may be changed. Changing the orientation can prevent any bubbles that are generated during the electropolishing process at the cathodes from interfering with the electropolishing process. The orientation is selected such that bubbles leaving the cathode 718 do not contact the stent 100 as they rise and do not interfere with the electropolishing process. For example, the orientation may be selected such that rising bubbles contact one of the rollers 708, 710, 712, or 714. The electropolishing fixture 700 may be oriented during the electropolishing process such that the cathode 718 is lateral to the stents 100, for example with the system 700 in a horizontal or slanted position.

After the stents 100 are electropolished, the fixture is removed out of the electrolytic bath 703, the orientation is restored and the stents are removed from the rollers after lifting the plate anode 702.

In order to avoid slippage of the stent 100 in the roller assembly (the rollers 708, 710, 712 and/or 714 are an example of a roller assembly), the rollers in the roller assembly and the anode plate should have an equal, or approximately equal surface speed. For instance, if the plate anode 702 move at 0.1 inch/sec, then the rotational speed of the roller should be set such that a point on the roller surface traverses approximately 0.1 inch/sec.

The rollers and plate anode illustrated herein are examples of a repositioning assembly.

In one example, the polishing process can be controlled by monitoring a weight of the stent before and after the stent polishing process and adjusting the electropolishing current and/or potentials of the anode/cathode. The data can be used to calculate a stent erosion rate (e.g., milligrams eroded per ampere-second) and this measure can be used to adjust the speed of the stent rotation, the electropolishing current and the time that the electropolishing current is applied for subsequent electropolishing processes. The data can thus be used to adjust the electropolishing process such that a desired amount of material is removed in order to achieve a desired polish and/or desired stent dimensions. The data may be stored in a memory of a computing device or server, for example. In addition, the systems and methods disclosed herein may be controlled by a computing system that includes a controller or processor.

In one example, the current is applied during full rotations of the stent and during an equal number of clockwise and counter-clockwise rotations to assure an even polishing. In one example, the current can be changed to provide a desired amount of material removal and/or provide a desired surface finish on both the inner and outer surfaces of the stent. Higher currents tend to polish the inner surface of the stent and lower currents tent to favor polishing the outer surface of the stent.

Thus, controlling the conditions (current, potential, speed of rotation, anode/cathode placement, or the like or any combination thereof) can be used to effectively control the resulting polish or finish of the stents.

Figure 8A:
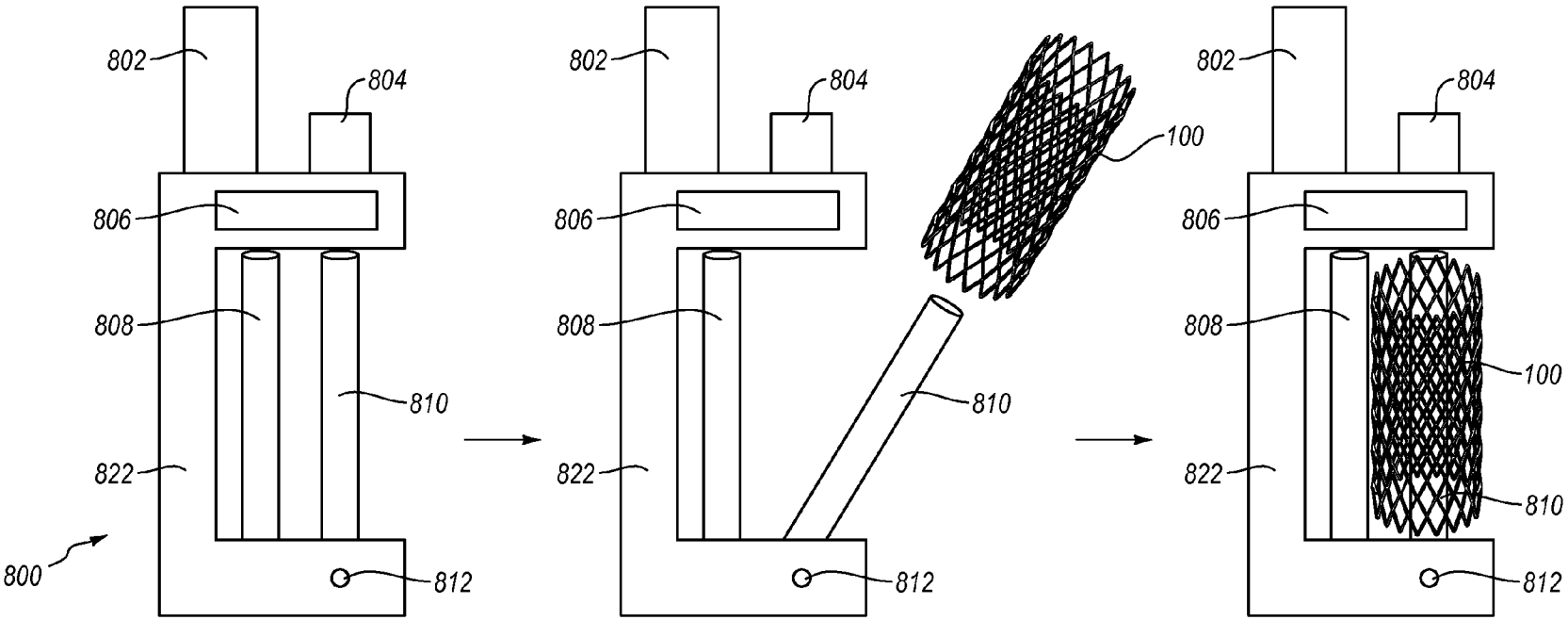
FIG. 8A illustrates a side view of an embodiment of a fixture for electropolishing a device.
Figure 8B:
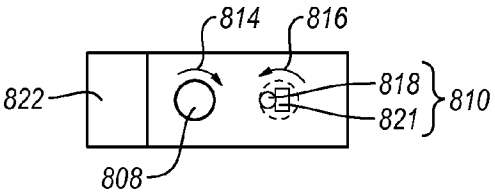
FIG. 8B illustrates a cross sectional view of the device shown in FIG. 8A.

FIG. 8A illustrates another example of an electropolishing fixture and an example of loading the electropolishing fixture 800. FIG. 8B illustrates a cross sectional view of the fixture 800. An electropolishing fixture 800 includes a body 822 having a top and a bottom.

The fixture 800 includes a drive 802 attached to a gear mechanism 806. The gear mechanism 806 is connected to at least one of a roller 808 and a roller assembly 810, also referred to as the roller 810. The gear mechanism 806 is effective to rotate the roller 808 and/or the roller 810. The gear mechanism 806 and the rollers 808 and 810 are an example of a repositioning assembly.

The fixture 800 can be used to electropolish a stent. In this example, the roller assembly 810 is hinged at a hinge point 812. FIG. 8A illustrates that the roller assembly 810 can be extended out from the body 822 by hinging at the hinge point 812 to be loaded with the stent 100, which slides down around the roller 810.

After the stent 100 is loaded on the roller assembly 810, the roller assembly 810, the roller assembly 810 is brought back into the body 822 and connected to the body 822 or to the gear mechanism 806. When the stent 100 is loaded on the roller assembly 810 and the roller assembly 810 is returned to the loaded position, the stent 100 is effectively pinched between the roller 808 and the roller assembly 810. More specifically, the stent 100 is pinched between the roller 808 and a roller included in the roller assembly 810.

The fixture 822 or a portion thereof may be immersed in a polishing solution. The gear mechanism 806 is then operated to rotate at least one of the roller 808 and the roller included in the roller assembly 810. In one example, as illustrated in FIG. 8B, the roller assembly 810 includes a roller 818 and a casing 820. The casing 820 enables the roller assembly 810 to hinge at the hinge point 821 such that an unpolished stent can be loaded and a polished stent can be removed.

While immersed in the polishing solution, the roller 808 rotates in one direction while the roller 818 rotates in another direction. By rotating these rollers, which may have different diameters, such that the surface rotational speed is substantially the same, the stent can be turned or rotated about the roller 808. Thus, the stent 100 is repositioned during the electropolishing process in order to more effectively polish the stent's surface.

The fixture 800 also includes a power transmission 804, which provides electrical power to the roller 818, which may operate as an anode. The cathode may also be placed in the polishing solution. Thus, the roller assembly provides a rotating anode such that the stent 100 can be electropolished by providing voltage to the roller assembly 810. The roller assembly 810 is typically sized such that only the roller 818 contacts the inner diameter of the stent 100.

As indicated herein, electropolishing a device such as a stent can remove metal from the surface of the stent. The surface finish of the stent can be improved by minimizing the time that any portion of the stent is in contact with the anode. As a result, rotating or repositioning the stent can reduce the time that any portion of the stent is in contact with the anode. This increases the flow of the polishing solution (e.g., electrolytic bath) across the surface of the stents and results in a more evenly polished stent.

An anode can be configured to both energize and support a stent, while repositioning the stent, during the electropolishing process. The ability to reposition the stent can be achieved, as discussed herein, using rollers, gears, a chain and sprocket assembly, flat plates, or the like (some of which may be electrodes. The required movement can be applied to rollers, plates, or the like.

Figure 9A:
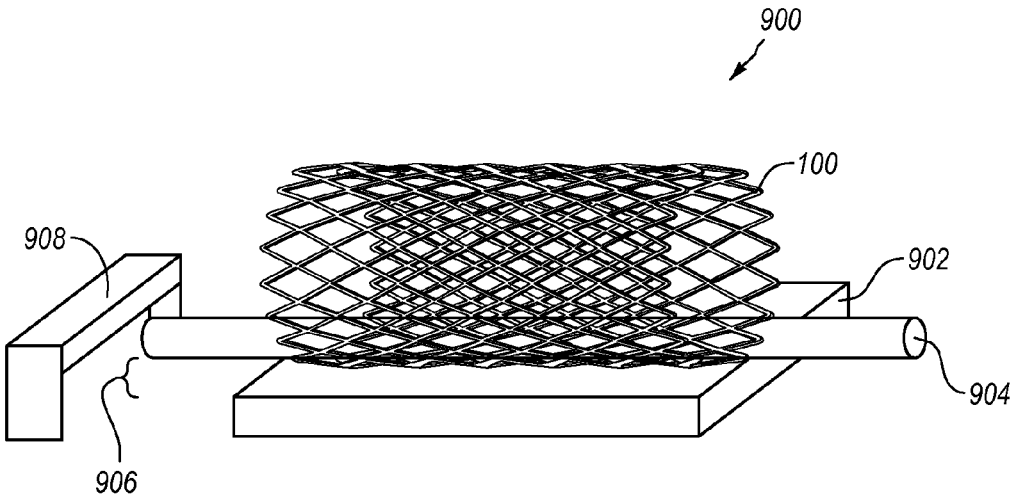
FIG. 9A illustrates a fixture for electropolishing a stent and includes a displacement sensor to control dimensions of the stent.
Figure 9B:
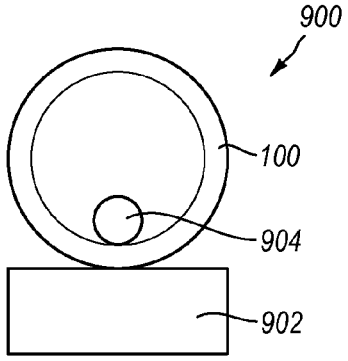
FIG. 9B illustrates a cross-section of FIG. 9A.

FIG. 9A illustrates a system or fixture configured to manage or control dimensions of a stent during an electropolishing process. FIG. 9B illustrates a cross sectional view of the system in FIG. 9A. The fixture 900 includes a mandrel 904, an anode plate 902 that are configured to rotate a stent during an electropolishing process. In this example, the anode plate 902 is move tangentially to the stent 100 while the stent 100 is pressed between the mandrel 904 and the plate anode 902. A cathode is also disposed in the system 900. In this example, a displacement sensor 908 is placed to contact the mandrel 904. The displacement sensor 908 is configured to monitor a distance 906 between the mandrel 904 and the plate anode 902. By monitoring the distance, various factors of the electropolishing process can be controlled to make the dimensions of the stent more even. For example, angular velocity, voltage, current, or the like are example of factors that can be controlled to polish the stent more evenly.

Figure 9C:
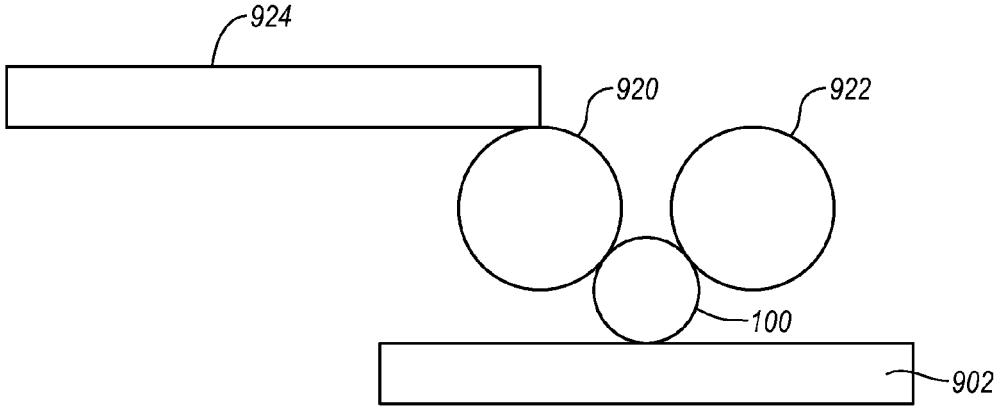
FIG. 9C illustrates another example of a fixture configured to monitor the dimensions of a stent and to control the electropolishing process.

In another example, the stent may be supported by rollers and placed between the rollers and the anode plate. FIG. 9C illustrates a stent supported between a plate anode and one or more rollers. FIG. 9C illustrates rollers 920 and 922 that cooperate with the plate anode 902 to rotate the stent during the electropolishing process. As the plate anode 902 moves laterally, the rollers 920 and 922 rotate. This movement causes the stent 100 to rotate.

In this example, the displacement of the rollers 920 or 922 or the plate anode 902 can be used to monitor and control the stent dimensions. Embodiments can thus enable the dimensions of the stent (e.g., thickness) to be controller more effectively. In one example, the thickness of the stent can be measured more precisely. For example, the displacement sensor 924, which is an example of the displacement sensor 908, may be placed in contact with one of the rollers (e.g., displacement sensor 924), or with the plate anode 902. Because the rollers 920 and 922 press towards the plate anode 902, the displacement between the surface of the rollers 920 and/or 922 and the plate anode 902 can be monitored. The change in the displacement between the rollers and/or of the plate anode can be used to determine the thickness of the stent during the polishing process.

In some embodiments, the stent may be held in place between rollers and/or a plate as previously stated. A bar arm of the displacement sensor 924 may rest on one of the rollers/plate or on the mandrel and movement of the displacement sensor 924 can be converted to a measurement of the stent's thickness.

The displacement sensor 908 can be calibrated to account for eccentricities in fixture 900, such as eccentricities in the rollers 920, 922. The relative position between the roller surface and the anode plate can be compensated for to improve the precision of the measurement.

By monitoring the dimensions of the stent during the electropolishing process, the system can control the stent position (e.g., relative to the plate anode 902) based on the stent thickness. Stent polishing can be tuned by placing portions of the stent that require faster polishing away from the plate anode 902 while portions that require less polishing can be positioned near the plate anode 902. This is useful, for example, when the thickness of the stent varies circumferentially.

In this example, a controller could be used to correlate the thickness of the stent 100 with an angular position of the stent in the fixture 900. The rate of erosion or of polishing can be controlled through manipulation of the current and/or voltage. By controller the rate of rotation, voltage, and/or current, the stent can be more even polished. This can be used to have greater control over the stent's final dimensions.

Figure 10:
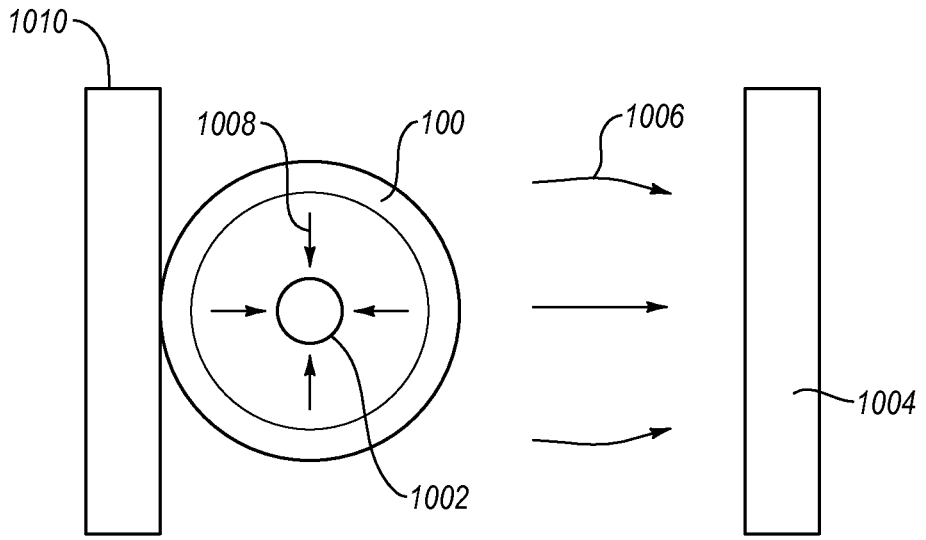
FIG. 10 illustrates an example of a fixture for electropolishing a stent that includes multiple cathodes, one of which is inside a lumen of the stent.

FIG. 10 illustrates an example of a fixture configured to polish a device such as a stent. Embodiments of the invention may also be configured to polish both the inner and outer diameters of a stent. FIG. 10 illustrates that a cathode 1002 may be positioned inside the lumen of the stent 100 and a cathode 1004 can be placed on the exterior of the stent. Positioning the cathodes 1002 and 1004 in these locations can enhance the polishing on both the inner and outer diameters of the stent 100. In some examples, the cathode 1002 inside the lumen can be de-energized in a controlled manner during the polishing process.

In one example, the anode may be a plate anode 1010 and the stent 100 is rotated against the plate anode 1010. The cathode 1002 may be placed through the interior diameter of the stent 100 (or through the stent's lumen) as well as outside of the stent like the cathode 1004. The cathode 1002 placed through the lumen may be a wire that is configured to be positioned within the stent's inner diameter without contacting the stent's inner surface. The inner cathode 1002 may be spiral shaped and may have a circular or non-circular cross section. By providing the inner cathode 1002, the inner surface of the stent 100 has a line of sight path to the cathode.

Current 1008 can thus flow from the inner diameter to the cathode 1002. Similarly, current 1006 can flow from the outer surface or diameter of the stent 100 to the cathode 1004.

The electrical source to the inner cathode 1002 can be the same source for the outer cathode 1004. Alternatively, the inner cathode 1002 and the outer cathode 1004 may have separate electrical sources. This enables the current and/or voltages to the inner/outer cathodes 1002, 1004 to be controlled independently. For example power can be supplied to the inner cathode 1002 for a shorter time, at a different voltage, or the like than the to the cathode 1004.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An electropolishing fixture for electropolishing a device, the fixture comprising:

an anode that receives the device in rotational engagement;

a plurality of lever arms, each lever arm including an elongate body with a distal end and a proximal end, an axis of rotation of each lever arm being disposed at and passing through the proximal end of the body and a device contacting surface formed by an exterior distal surface of the distal end of body, wherein the plurality of lever arms are configured to rotate about an axis, move perpendicularly relative to the device, and move tangentially to an outer surface of the device;

a controller configured to control movement of the plurality of lever arms such that the movement of the plurality of lever arms repositions the device during an electropolishing process while maintaining at least a portion of the device in contact with the anode and the device contacting surface formed by the exterior distal surface of the elongate body.

2. The electropolishing fixture of claim 1, wherein the controller controls the movement of each of the lever arms individually or in groups.

3. The electropolishing fixture of claim 1, wherein the body includes a curve.

4. The electropolishing fixture of claim 1, wherein the plurality of lever arms are controlled by the controller to press the device against an anode passing through a lumen of the device to establish electrical contact between the anode and the device and rotate the device about the anode while current passes through the anode and the device during an electropolishing process.

5. The electropolishing fixture of claim 4, wherein the plurality of lever arms take turns rotating the device about the anode, wherein the plurality of lever arms include a first lever arm and a second lever arm, wherein the first lever arm rotates the device while moving from an initial position to an extended position and when the first lever arm reaches an extended position the second lever arm begins rotating the device from an initial position.

6. The electropolishing fixture of claim 1, wherein the distal ends of the plurality of lever arms include rollers or bars configured to press against the device.

7. The electropolishing fixture of claim 1, wherein the plurality of lever arms reposition the device by rotating the device in a first direction and in a second direction.

8. The electropolishing fixture of claim 1, wherein the distal end includes features configured to grip the device to facilitate rotation of the device.

9. An eletropolishing fixture for electropolishing a device, the fixture comprising:

an anode;

a plurality of lever arm, each lever arm including an elongate body with a distal end portion and a proximal end portion, the distal end portion including gripping features which are directly on the elongate body to increase grip between a surface of the lever arm and the device, the gripping features are selected from the group consisting of teeth or brush-like bristles associated with the distal end portion, wherein the plurality of lever arms are configured to rotate about an axis, move perpendicularly relative to the device, and move tangentially to an outer surface of the device;

a controller configured to control movement of the plurality of lever arms to rotate the device, a combination of the movement of the plurality of lever arms by the controller and the gripping features rotate the device during an electropolishing process while maintaining at least a portion of the device in contact with the anode.

10. The electropolishing fixture of claim 9, wherein the plurality of lever arms are configured to rotate about an axis, move perpendicularly relative to the device, and move tangentially to an outer surface of the device.

11. The electropolishing fixture of claim 9, wherein each lever arm includes a plurality of curved portions.

12. The electropolishing fixture of claim 9, where the distal end portion is planar.

13. An electropolishing fixture for electropolishing a device, the fixture comprising:

an anode that receives the device in rotational engagement;

a plurality of lever arms, each lever arm including a distal end portion and a proximal end portion, each lever arm is configured to rotate about an axis, move perpendicularly relative to the device, and move tangentially to an outer surface of the device;

a controller configured to selectively raise and lower the plurality of lever arms relative to the device such that the movement of the plurality of lever arms causes the distal end portion to move in a tangential direction relative to the device to rotate the device during movement of the plurality of lever arms to reposition the device during an electropolishing process while maintaining at least a portion of the device in contact with the anode.

14. The electropolishing fixture of claim 13, wherein the controller controls the movement of each of the lever arms individually or in groups.

15. The electropolishing fixture of claim 13, wherein each lever arm includes a body extending between the distal end and the proximal end, wherein the body includes a curve.

16. The electropolishing fixture of claim 13, wherein the plurality of lever arms are controlled by the controller to press the device against an anode passing through a lumen of the device to establish electrical contact between the anode and the device and rotate the device about the anode while current passes through the anode and the device during an electropolishing process.

17. The electropolishing fixture of claim 16, wherein the plurality of lever arms take turns rotating the device about the anode, wherein the plurality of lever arms include a first lever arm and a second lever arm, wherein the first lever arm rotates the device while moving from an initial position to an extended position and when the first lever arm reaches an extended position the second lever arm begins rotating the device from an initial position.

18. The electropolishing fixture of claim 13, wherein the distal ends of the plurality of lever arms include rollers or bars configured to press against the device.

* * * * *